US012797929B2

(12) United States Patent
Horii et al.

(10) Patent No.: US 12,797,929 B2
(45) Date of Patent: Nov. 17, 2026

(54) ROLLING MILL AND ROLLING METHOD

(71) Applicant: Primetals Technologies Japan, Ltd., Hiroshima (JP)

(72) Inventors: Kenji Horii, Hiroshima (JP); Tatsunori Sugimoto, Hiroshima (JP); Toshihiro Usugi, Hiroshima (JP); Akio Kuroda, Hiroshima (JP)

(73) Assignee: PRIMETALS TECHNOLOGIES JAPAN, LTD., Hiroshima (JP)

( * ) Notice: Subject to any disclaimer, the term of this patent is extended or adjusted under 35 U.S.C. 154(b) by 256 days.

(21) Appl. No.: 18/697,558

(22) PCT Filed: Oct. 19, 2021

(86) PCT No.: PCT/JP2021/038619
§ 371 (c)(1),
(2) Date: Apr. 1, 2024

(87) PCT Pub. No.: WO2023/067696
PCT Pub. Date: Apr. 27, 2023

(65) Prior Publication Data

US 2024/0408659 A1 Dec. 12, 2024

(51) Int. Cl.
*B21B 37/28* (2006.01)
*B21B 13/14* (2006.01)
*B21B 27/02* (2006.01)

(52) U.S. Cl.
CPC ..... *B21B 37/28* (2013.01); *B21B 27/021* (2013.01)

(58) Field of Classification Search
CPC ..... B21B 37/28; B21B 27/021; B21B 13/142; B21B 27/02
See application file for complete search history.

(56) References Cited

U.S. PATENT DOCUMENTS 5,657,655 A * 8/1997 Yasuda ..... B21B 37/32 72/236
6,076,388 A * 6/2000 Kajiwara ..... B21B 13/023 72/236
2019/0047028 A1* 2/2019 Sako ..... B21B 37/18

FOREIGN PATENT DOCUMENTS

JP 63-264204 A 11/1988
JP 5-285504 A 11/1993
(Continued)

OTHER PUBLICATIONS

International Search Report of PCT/JP2021/038619 dated Jan. 1, 2022.

*Primary Examiner* — Mohammed S. Alawadi
(74) *Attorney, Agent, or Firm* — MATTINGLY & MALUR, PC

(57) ABSTRACT

A control device of a rolling mill includes first and second angle instruction sections that issue a first instruction to adjust an angle between an upper side pair and a lower side pair in a state in which the upper side pair has a parallel state and in a state in which the lower side pair has a parallel state; and a second instruction to tilt work rolls in a state in which an angle between backup rolls is maintained. An axial position instruction is issued to move the work rolls in a direction in which total thrust force received, by the work rolls tilted by the second instruction, from the backup rolls and a rolled material acts. The work roll pressing devices, work roll fixed position controlling devices, and shift cylinders are controlled on the basis of the first and second instructions, and the axial position instruction.

14 Claims, 11 Drawing Sheets

(56) References Cited

FOREIGN PATENT DOCUMENTS

| | | | |
|---|---|---|---|
| JP | 07-32002 | A | 2/1995 |
| WO | 2018083794 | A1 | 5/2018 |

* cited by examiner

ROLLING MILL AND ROLLING METHOD

TECHNICAL FIELD

The present invention relates to a rolling mill and a rolling method.

BACKGROUND ART

As an example of a rolling mill that can properly control strip crown and edge drop by simple work, there is a rolling mill described in Patent Document 1 including: a pair of rolling rolls on which crowning is implemented with change amounts of the diameters that are given by $ax^5$-$bx^2$-cx relative to a coordinate X which lies from the centers of the lengths of the barrels along the axial direction, the pair of rolling rolls being arranged to be point symmetric with each other; roll shift means that move the rolling rolls relatively in the axial direction; and roll cross means that tilt the rolling rolls in mutually opposite directions on a plane parallel to a rolled material.

PRIOR ART DOCUMENT

Patent Document

Patent Document 1: JP-S63-264204-A

SUMMARY OF THE INVENTION

Problems to be Solved by the Invention

There are demands regarding the precision of rolled products, in particular the strip thickness precision in the strip width direction, that are demanded to be satisfied. Major ones of strip thickness anomalies in the strip width direction include: strip crown in which a middle section of a metallic strip in the strip width direction gets thick; and edge drop or edge up in which areas extending from both ends in the strip width direction approximately for predetermined distances have strip thicknesses that change rapidly.

As one of technologies to attempt to enhance the strip thickness precision, there is a technology described in Patent Document 1 mentioned above. In Patent Document 1, strip crown and edge drop are suppressed by causing the upper and lower curved work rolls on which the crowning is implemented to cross after being shifted.

However, since, in either case of curved work rolls or uncurved rolls, thrust force in the axial direction is generated by a slight inclination between the roll shafts of the contacting rolls, resistance force is generated when the rolls are shifted in the axial direction, and in particular the resistance force increases during rolling since rolling load acts on the work rolls. Because of this, an improvement for realizing shift of rolls during rolling is demanded.

An object of the present invention is to provide a rolling mill and a rolling method that appropriately control the shape of a rolled material, and make it easier to execute roll shift during rolling as compared to conventional technologies.

Means for Solving the Problems

The present invention includes a plurality of means for solving the problems described above, and an example thereof is a rolling mill including: a pair of upper and lower work rolls having curved contours with diameters that increase and decrease repetitively from one end to another end in an axial direction, the pair of upper and lower work rolls being arranged to be point symmetric with each other; a pair of upper and lower backup rolls that support the work rolls, respectively; work roll horizontal direction actuators that move the work rolls in a horizontal direction; work roll axial direction actuators that move the work rolls in the axial direction; and a control device that controls angle adjustment performed by the work roll horizontal direction actuators, and axial position adjustment performed by the work roll axial direction actuators, in which the control device has: a first angle instruction section that issues an instruction to adjust an angle between an upper side pair of the upper work roll and the upper backup roll and a lower side pair of the lower work roll and the lower backup roll in a state in which the upper side pair has a parallel state and besides in a state in which the lower side pair has a parallel state; a second angle instruction section that issues an instruction to tilt the work rolls in a state in which an angle between the backup rolls is maintained; and an axial position instruction section that issues an instruction to move the work rolls in a direction in which total thrust force received, by the work rolls tilted by the instruction issued by the second angle instruction section, from the backup rolls and a rolled material acts, and the control device controls the work roll horizontal direction actuators and the work roll axial direction actuators on a basis of the instructions issued by the first angle instruction section, the second angle instruction section, and the axial position instruction section.

Advantages of the Invention

According to the present invention, it is possible to obtain a rolling mill and a rolling method that appropriately control the shape of a rolled material, and make it easier to execute roll shift during rolling as compared to conventional technologies. Problems, configuration and advantages other than those described above are made clear by the following explanation of an embodiment.

MODES FOR CARRYING OUT THE INVENTION

Figure 1:
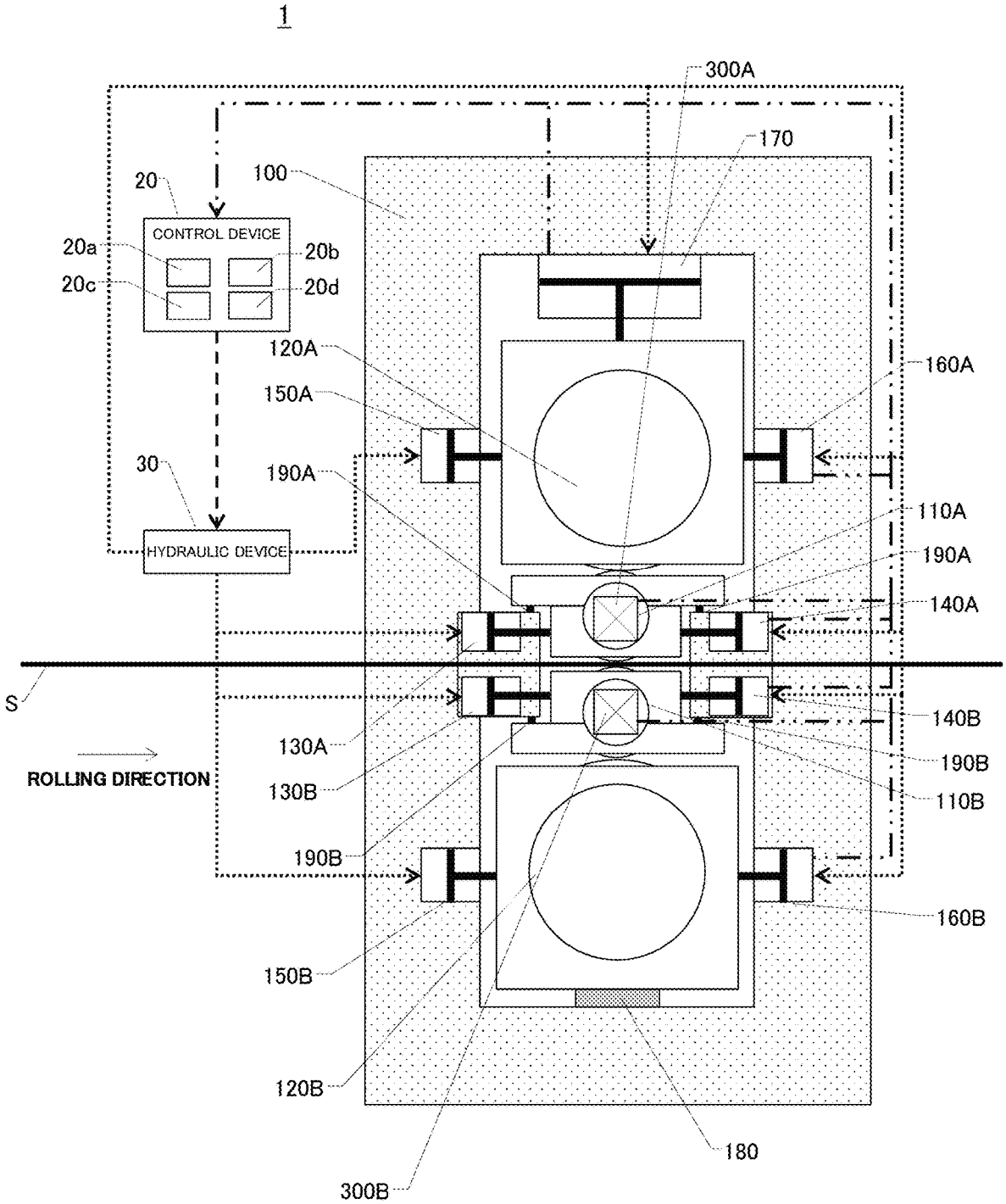
FIG. 1 is a side view depicting the device configuration of a rolling mill according to an embodiment of the present invention.

An embodiment of a rolling mill and a rolling method of the present invention are explained by using FIG. 1 to FIG. 11.

Note that identical or corresponding constituent elements in the figures used in the present specification are given identical or similar reference characters, and repetitive explanations of these constituent elements are omitted in some cases.

In addition, in the following explanation and figures, a drive side (written also as a "DS (Drive Side)") means a side where electric motors to drive work rolls are installed when a rolling mill is seen from its front side, and a work side (written also as a "WS (Work Side)") means the opposite side.

Figure 2:
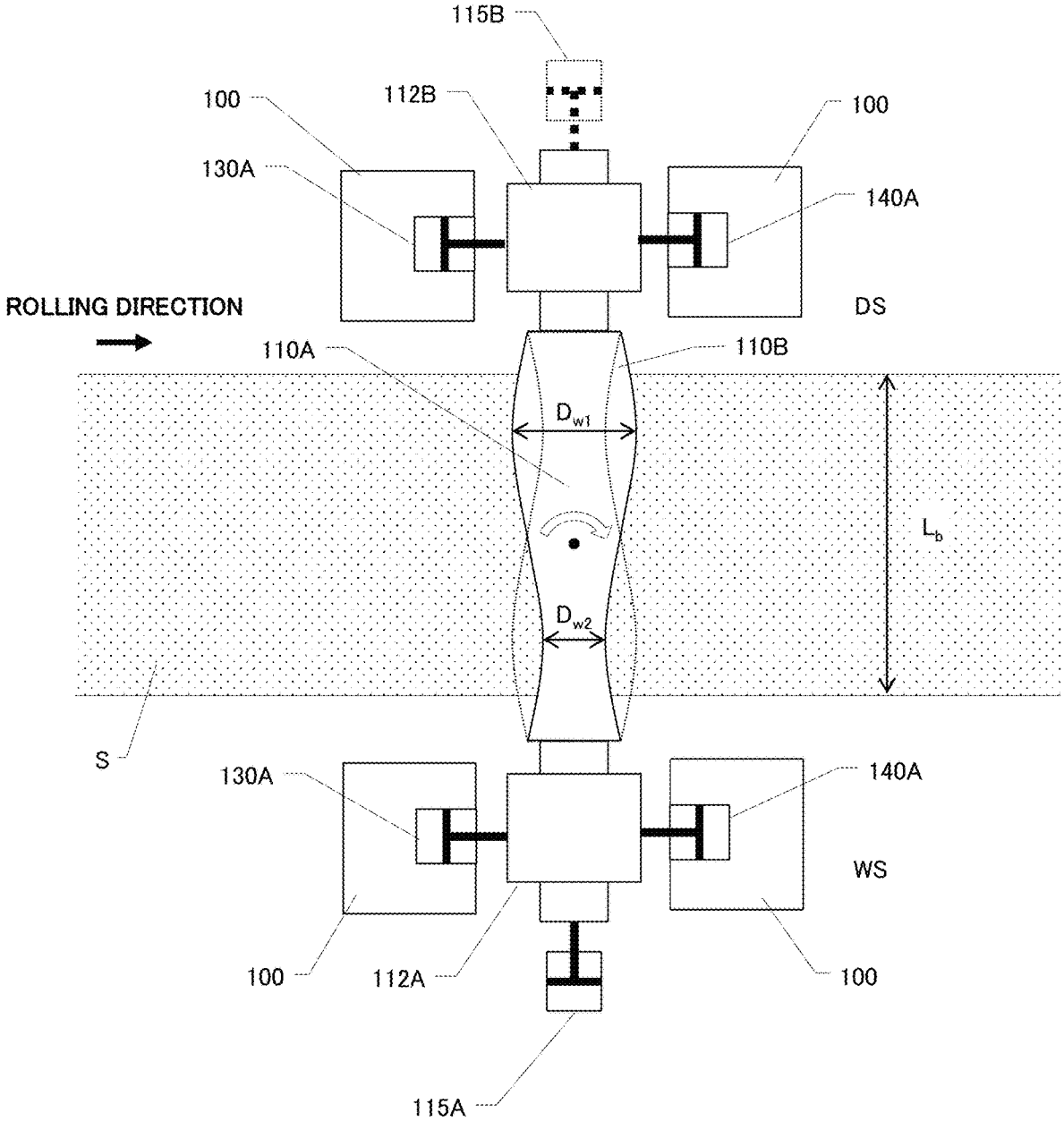
FIG. 2 is a top view depicting an overview of the configuration of a facility around an upper work roll in the rolling mill depicted in FIG. 1.
Figure 3:
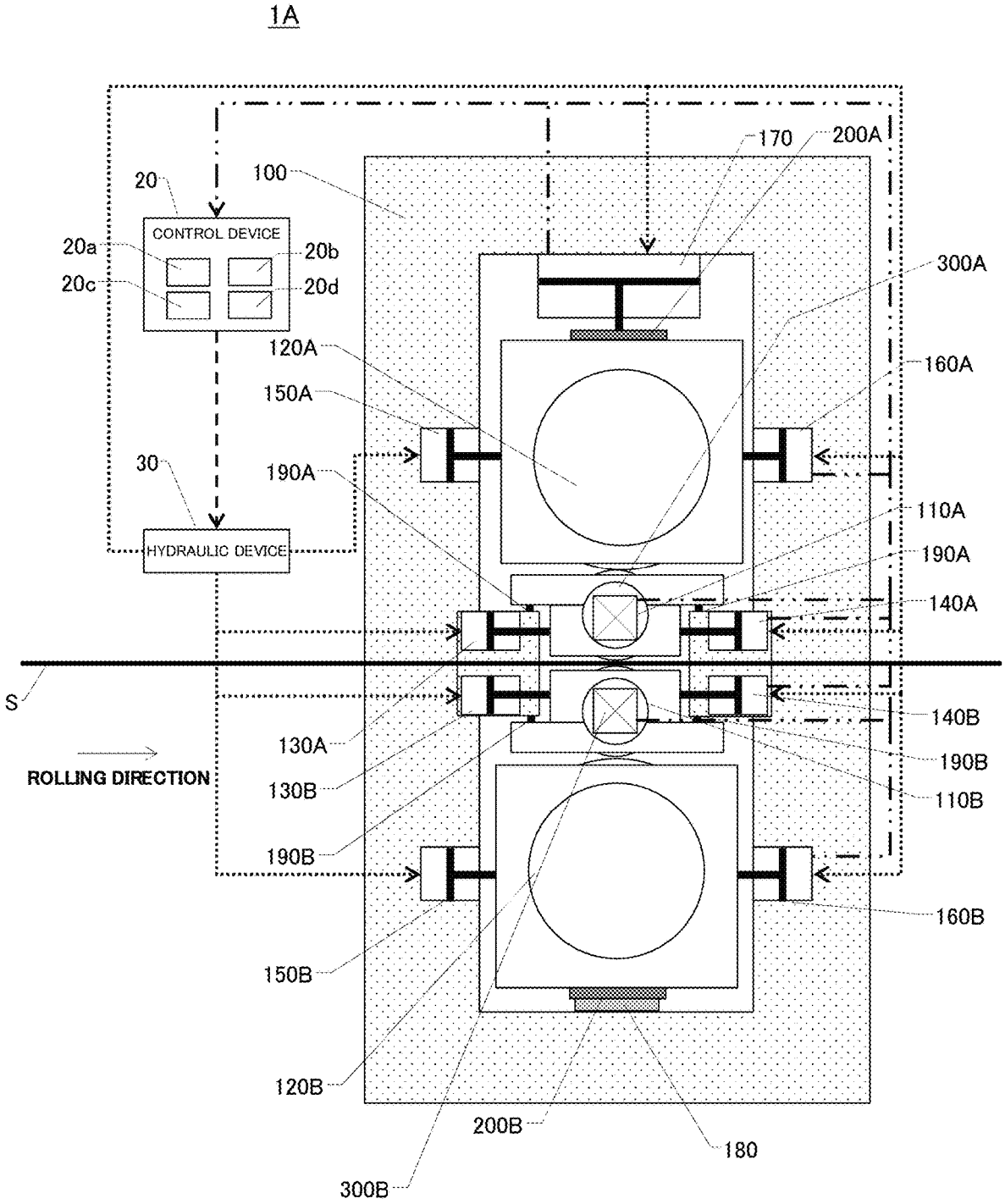
FIG. 3 is a side view depicting another example of the device configuration of the rolling mill according to the embodiment.

First, the overall configuration of a rolling mill is explained by using FIG. 1 and FIG. 2. FIG. 1 is a side view of the rolling mill according to the present embodiment, and FIG. 2 is a top view depicting an overview of the configuration of a facility around an upper work roll in the rolling mill depicted in FIG. 1.

In FIG. 1, a rolling mill 1 is a four-high cross roll rolling mill that rolls a rolled material S, and has a housing 100, a control device 20, and a hydraulic device 30. Note that the rolling mill is not necessarily a rolling mill with one rolling mill stand like the one depicted in FIG. 1, but can be a rolling mill including two rolling mill stands or more.

The housing 100 includes a pair of upper work roll (written also as a "WR") 110A and a lower work roll 110B, an upper backup roll (written also as a "BUR") 120A that supports the upper work roll 110A, and a lower backup roll 120B that supports the lower work roll 110B. These backup rolls 120A and 120B also are arranged as a pair of upper and lower rolls, and are straight rolls whose contour in the axial direction is straight.

As depicted in FIG. 2, each of the upper work roll 110A and the lower work roll 110B according to the present embodiment is a curved roll having a curved contour with a diameter $D_w$ that increases and decreases repetitively from one end to the other end in the axial direction, and the upper work roll 110A and the lower work roll 110B are arranged to be point symmetric with each other. Here, the position of the "point" in the "point symmetry" in the present invention is either the geometric center of the rolled material S in the strip width direction or the geometric center of the rolling mill 1 as seen in the rolling direction or in the direction opposite to the rolling direction, and changes as appropriate depending on rolling conditions.

Screw-down cylinder devices 170 are cylinders that apply screw-down force to the upper backup roll 120A, the upper work roll 110A, the lower work roll 110B, and the lower backup roll 120B by pressing the upper backup roll 120A. The screw-down cylinder devices 170 are provided on the work side and the drive side of the housing 100.

As rolling force measurement means for measuring rolling force of the rolled material S applied by the upper work roll 110A and the lower work roll 110B, a load cell 180 is provided at a lower portion of the housing 100, and outputs measurement results to the control device 20.

Upper work roll bending cylinders 190A are provided on the entry side and the exit side of the rolled material S in the housing 100 on each of the work side and the drive side. Driving, as appropriate, the upper work roll bending cylinders 190A applies bending force vertically to bearings of the upper work roll 110A.

Similarly, lower work roll bending cylinders 190B are provided on the entry side and the exit side of the rolled material S in the housing 100 on each of the work side and the drive side, and driving, as appropriate, the lower work roll bending cylinders 190B applies bending force vertically to bearings of the lower work roll 110B.

Thrust force measuring devices 300A and 300B measure thrust force acting on the shafts of the upper work roll 110A and the lower work roll 110B, respectively.

The hydraulic device 30 is connected to hydraulic cylinders of work roll pressing devices 130A and 130B and work roll fixed position controlling devices 140A and 140B, hydraulic cylinders of backup roll pressing devices 150A and 150B and backup roll fixed position controlling devices 160A and 160B, and shift cylinders 115A and 115B, and furthermore to the upper work roll bending cylinder 190A and the lower work roll bending cylinder 190B also. Note that parts of communication lines and hydraulic fluid supply lines are omitted in FIG. 1 for convenience of illustration. The same applies also to the following figures.

The control device 20 is a device configured by using a computer or the like that controls operations of each piece of equipment in the rolling mill 1, and, in the present implementation example, has a first angle instruction section 20*a*, a second angle instruction section 20*b*, an axial position instruction section 20*c*, an angle acquiring section 20*d*, and the like.

The control device 20 receives input of measurement result signals of thrust force acting on the shafts of the work rolls 110A and 110B measured with the thrust force measuring devices 300A and 300B, and measurement signals from the load cell 180 and position measuring instruments of the work roll fixed position controlling devices 140A and 140B and the backup roll fixed position controlling devices 160A and 160B.

The control device 20 controls actuation of the hydraulic device 30 on the basis of instructions issued by the first angle instruction section 20*a*, the second angle instruction section 20*b*, and the axial position instruction section 20*c*, and supplies and discharges hydraulic fluid to and from the hydraulic cylinders of the work roll pressing devices 130A and 130B and the work roll fixed position controlling devices 140A and 140B, and the shift cylinders 115A and 115B to thereby control actuation of angle adjustment performed by the work roll pressing devices 130A and 130B and the work roll fixed position controlling devices 140A and 140B, and axial position adjustment performed by the shift cylinders 115A and 115B.

Similarly, the control device 20 controls actuation of the hydraulic device 30, and supplies and discharges hydraulic fluid to and from the hydraulic cylinders of the backup roll pressing devices 150A and 150B and the backup roll fixed position controlling devices 160A and 160B to thereby control actuation of angle adjustment performed by the backup roll pressing devices 150A and 150B and the backup roll fixed position controlling devices 160A and 160B.

Furthermore, the control device 20 supplies and discharges hydraulic fluid to the upper work roll bending cylinder 190A and the lower work roll bending cylinder 190B to thereby control actuation thereof.

Next, configuration related to the upper work roll 110A and the lower work roll 110B is explained by using FIG. 2. Note that the upper backup roll 120A and the lower backup roll 120B also have configuration equivalent to that of the upper work roll 110A and the lower work roll 110B in other respects than the roll shapes and whether or not there are the shift cylinders 115A and 115B, and detailed explanations thereof are approximately the same, and accordingly are omitted.

As depicted in FIG. 2, there is the housing 100 on both end sides of the upper work roll 110A of the rolling mill 1, and is provided to stand perpendicular to the roll shaft of the upper work roll 110A.

The upper work roll 110A is rotatably supported by the housing 100 via a work side roll chock 112A and a drive side roll chock 112B.

On each of the work side and the drive side, a work roll pressing device 130A is arranged between the entry side of the housing 100 and the work side roll chock 112A or the drive side roll chock 112B, and presses the work side roll chock 112A or the drive side roll chock 112B of the upper work roll 110A in the rolling direction at predetermined pressure.

On each of the work side and the drive side, a work roll fixed position controlling device 140A is arranged between the exit side of the housing 100 and the work side roll chock 112A or the drive side roll chock 112B, and has a hydraulic cylinder (pressing device) that presses the work side roll chock 112A or the drive side roll chock 112B of the upper work roll 110A in the direction opposite to the rolling direction. The work roll fixed position controlling device 140A includes a position measuring instrument (illustration omitted) that measures the amount of operation of the hydraulic cylinder, and controls the position of the hydraulic cylinder.

Here, a fixed position controlling device means a device that measures the hydraulic column position of a hydraulic cylinder as a pressing device by using a position measuring instrument incorporated in the device, and controls the hydraulic column position until the hydraulic column reaches a predetermined hydraulic column position.

These work roll pressing devices 130A and 130B, backup roll pressing devices 150A and 150B, and fixed position controlling devices 140A, 140B, 160A, and 160B play roles of angle adjustors that adjust the cross angles of the work rolls 110A and 110B and the backup rolls 120A and 120B.

Note that whereas FIG. 1 and FIG. 2 depict an example in which hydraulic devices are used as the work roll fixed position controlling devices 140A and 140B and the backup roll fixed position controlling devices 160A and 160B which are actuators of crossing devices, they are not necessarily hydraulic devices, but devices with electric configuration or the like can be used.

In addition, whereas the work roll pressing devices are disposed on the entry side of the rolled material S, and the work roll fixed position controlling devices are disposed on the exit side of the rolled material S in the depicted configuration, they are disposed on the opposite sides in some cases, and their arrangement is not necessarily the pattern depicted in FIG. 1 and the like.

Furthermore, whereas FIG. 1 and FIG. 2 depict an example in which the pressing devices are included opposite the fixed position controlling devices, this is not essential, but only the fixed position controlling devices are included in other possible configuration. It should be noted that installation of the pressing devices makes it possible to eliminate backlashes between the roll chocks 112A and 112B and the fixed position controlling devices, and to stabilize the positions of the roll chocks 112A and 112B in the rolling direction.

The shift cylinder 115A is a cylinder that moves the upper work roll 110A in the axial direction. The shift cylinder 115B is a cylinder that moves the lower work roll 110B in the axial direction.

Returning to FIG. 1, on each of the work side and the drive side, a backup roll pressing device 150A is arranged between the entry side of the housing 100 and the work side roll chock or the drive side roll chock (illustration omitted), and presses the work side roll chock or the drive side roll chock of the upper backup roll 120A in the rolling direction at predetermined pressure.

On each of the work side and the drive side, a backup roll fixed position controlling device 160A is arranged between the exit side of the housing 100 and the work side roll chock or the drive side roll chock, and has a hydraulic cylinder (pressing device) that presses the work side roll chock or the drive side roll chock of the upper backup roll 120A in the direction opposite to the rolling direction. The backup roll fixed position controlling device 160A includes a position measuring instrument (illustration omitted) that measures the amount of operation of the hydraulic cylinder, and controls the position of the hydraulic cylinder. Note that whereas the backup roll pressing devices are disposed on the exit side of the rolled material S, and the backup roll fixed position controlling devices are disposed on the entry side of the rolled material S in the depicted configuration, they are disposed on the opposite sides in some cases, and their arrangement is not necessarily the pattern depicted in FIG. 1 and the like.

Note that the configuration of the rolling mill is not necessarily that depicted in FIG. 1. For example, like a rolling mill 1A according to the present embodiment depicted in FIG. 3, the rolling mill 1 in FIG. 1 can be further provided with backup roll sliding devices 200A and 200B.

The backup roll sliding device 200A is provided at a portion vertically above the upper backup roll 120A, and the backup roll sliding device 200B is provided at a portion vertically below the lower backup roll 120B.

Figure 4:
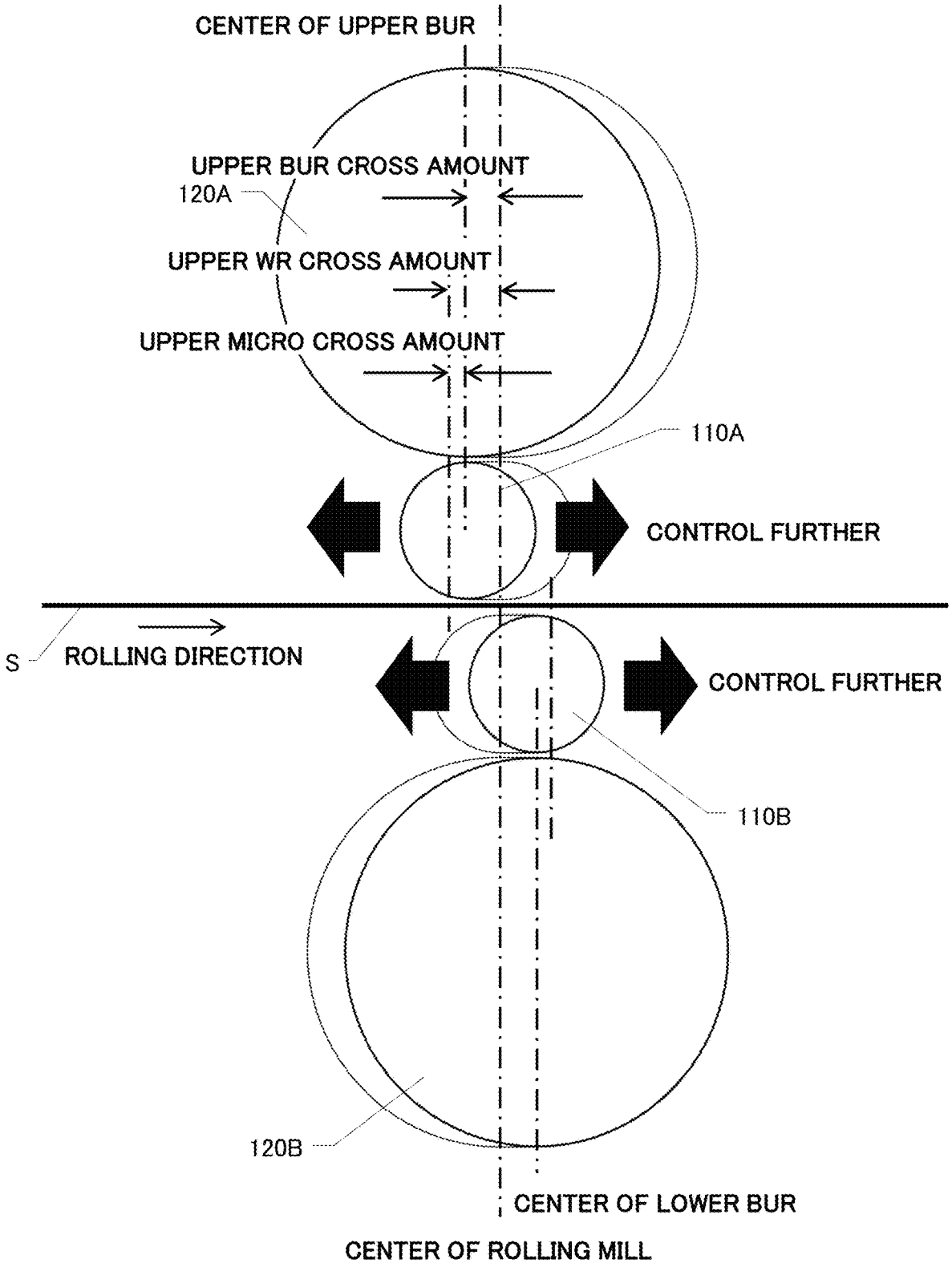
FIG. 4 is a figure for explaining the center of each roll in a crossed state in the rolling mill according to the embodiment.
Figure 5:
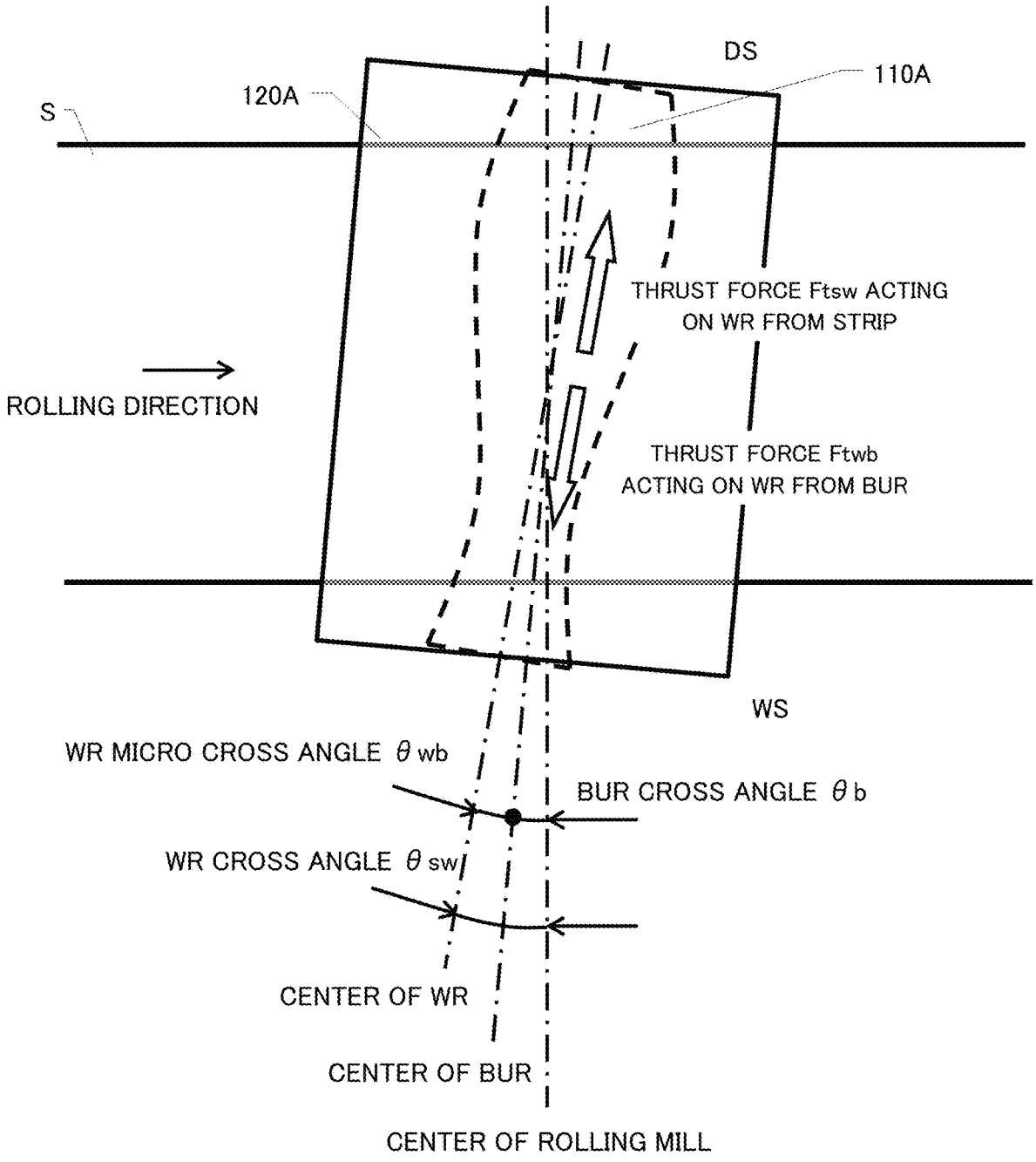
FIG. 5 is a figure for explaining each cross angle and each type of thrust force in the rolling mill according to the embodiment.
Figure 6:
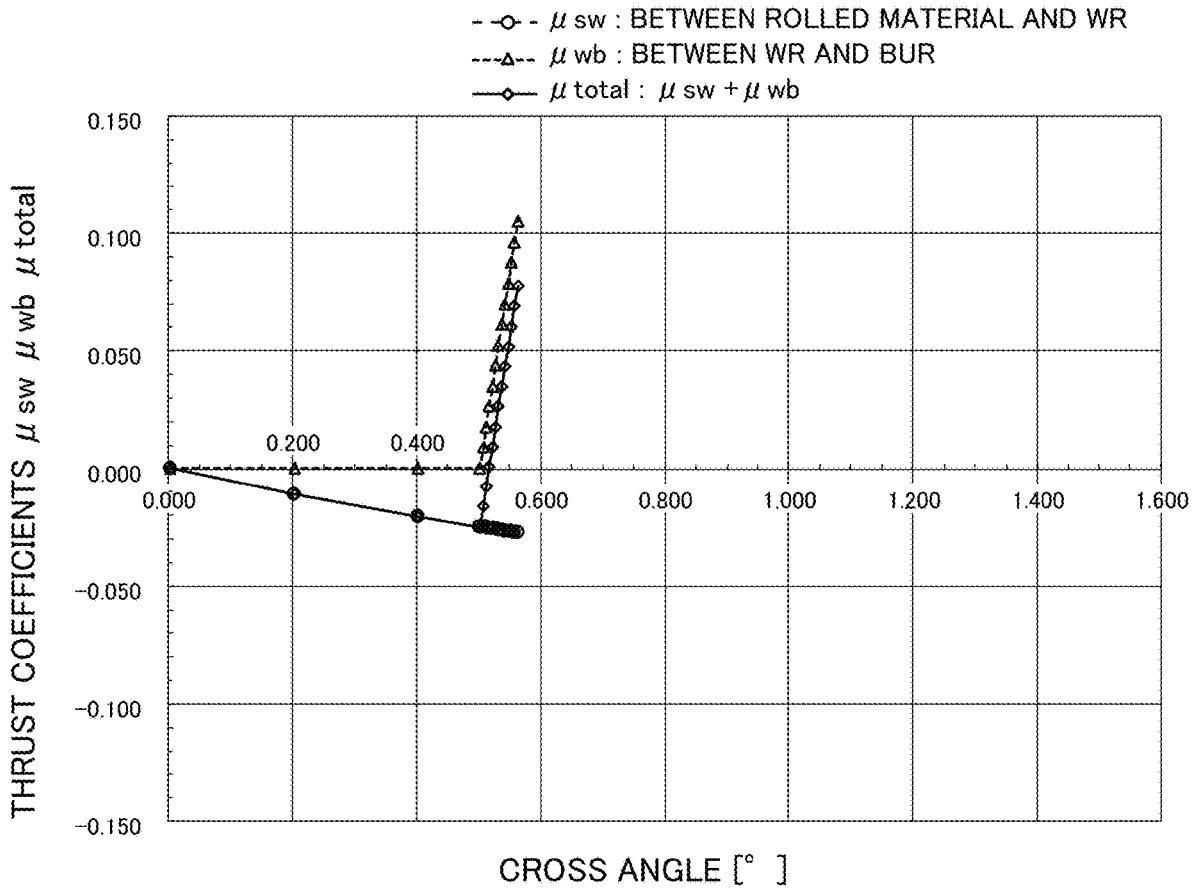
FIG. 6 is a figure depicting the relationship between the cross angles and thrust coefficients at the time when a backup roll cross angle $\theta b=0.5°$ in the rolling mill.
Figure 7:
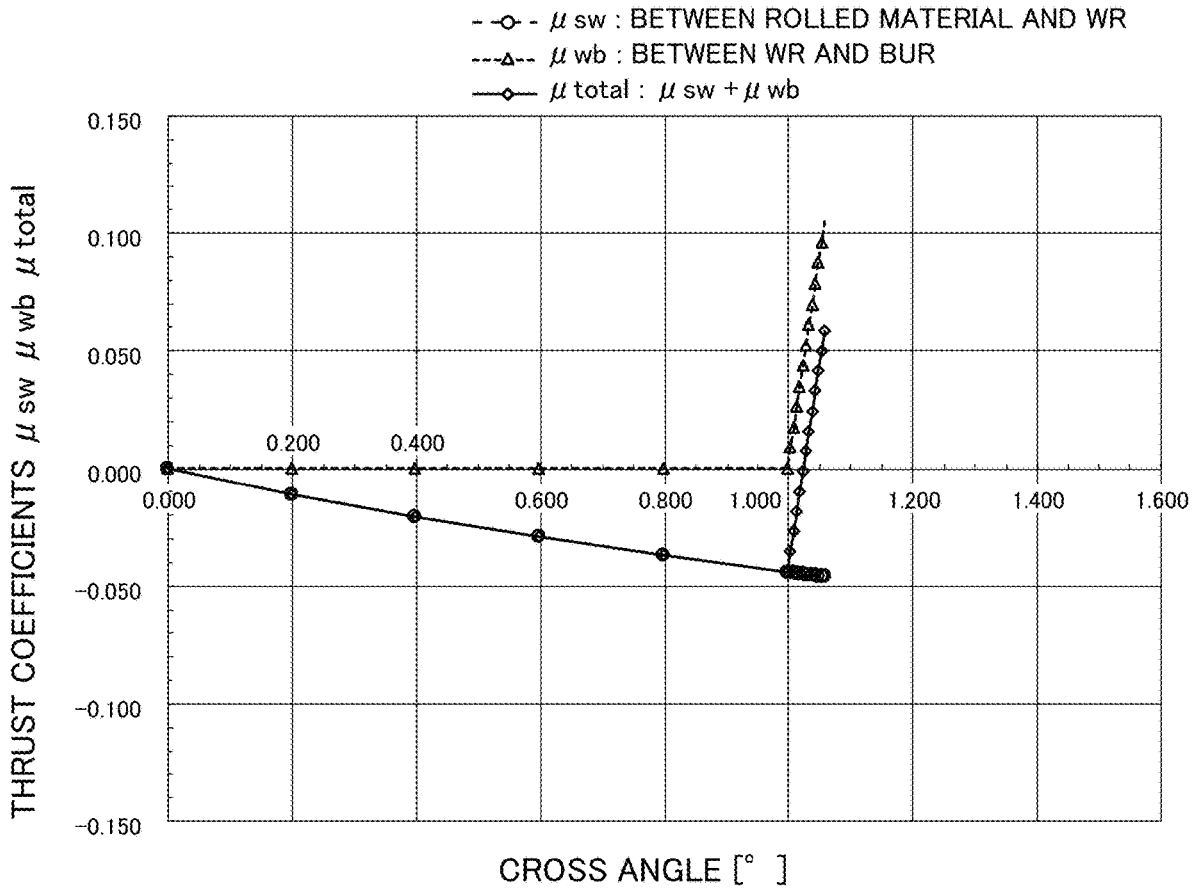
FIG. 7 is a figure depicting the relationship between the cross angles and the thrust coefficients at the time when the backup roll cross angle $\theta b=1.0°$ in the rolling mill.
Figure 8:
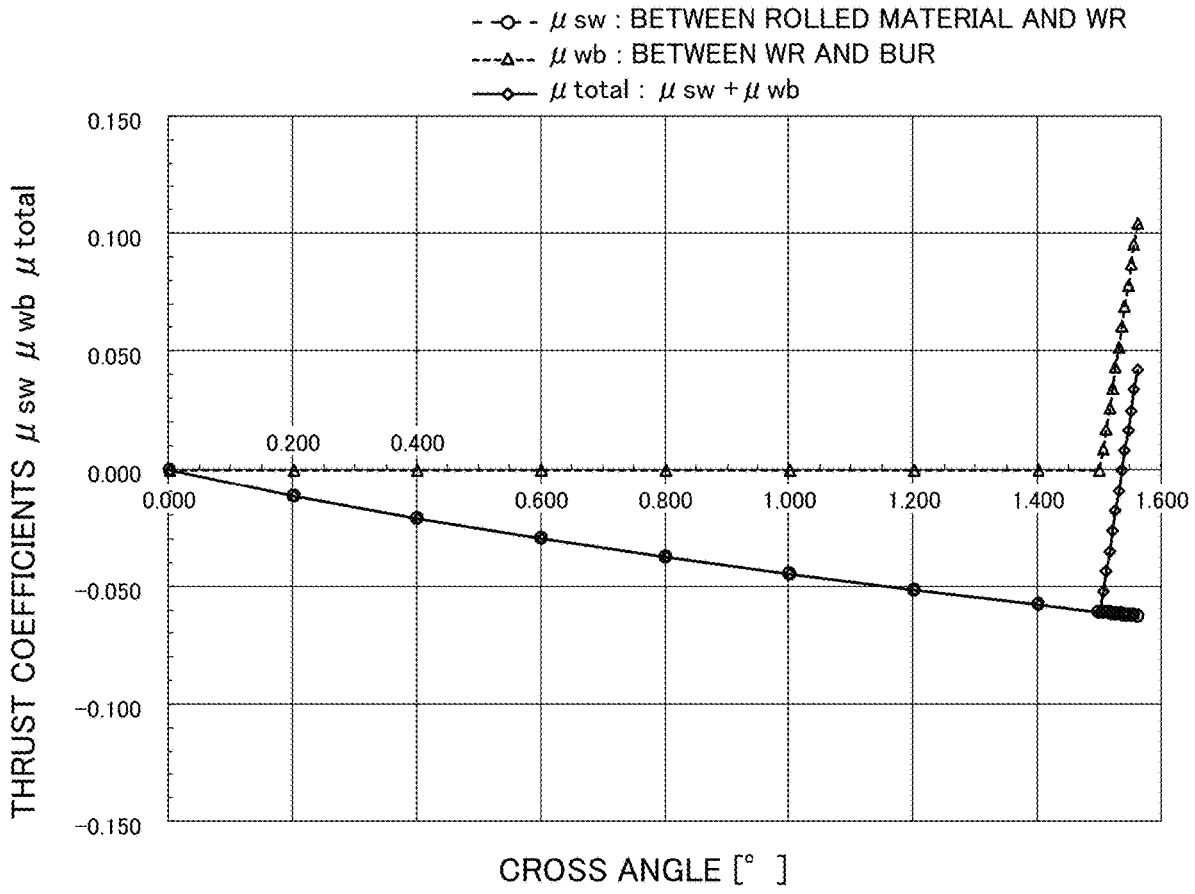
FIG. 8 is a figure depicting the relationship between the cross angles and the thrust coefficients at the time when the backup roll cross angle $\theta b=1.5°$ in the rolling mill.
Figure 9:
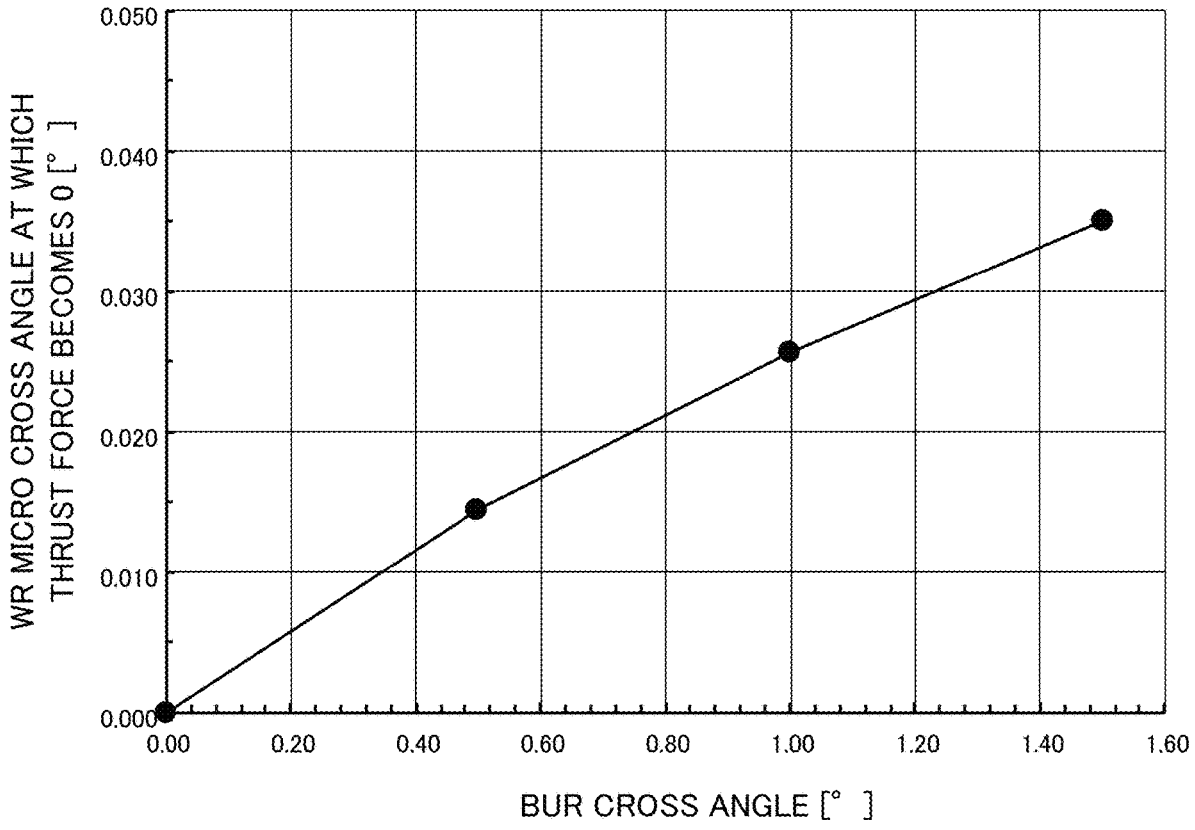
FIG. 9 is a figure depicting the relationship between the backup roll cross angle θb and $\theta wb_{base}$ at which the thrust force becomes 0 in the rolling mill.
Figure 10:
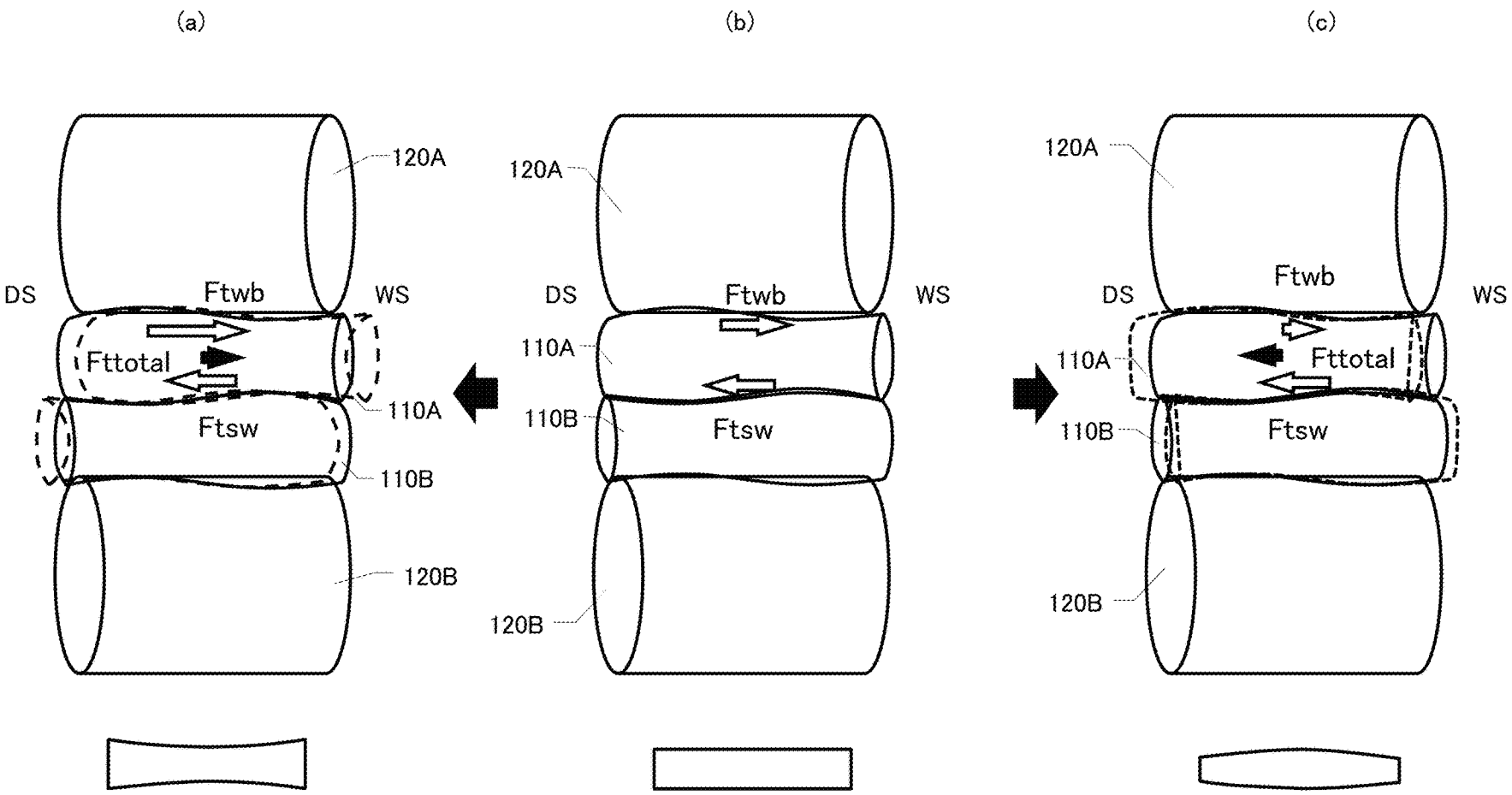
FIG. 10 is a figure depicting a state, as seen from the rolling direction entry side, when the backup roll cross angle is a certain angle (≠0) in the rolling mill according to the embodiment.
Figure 11:
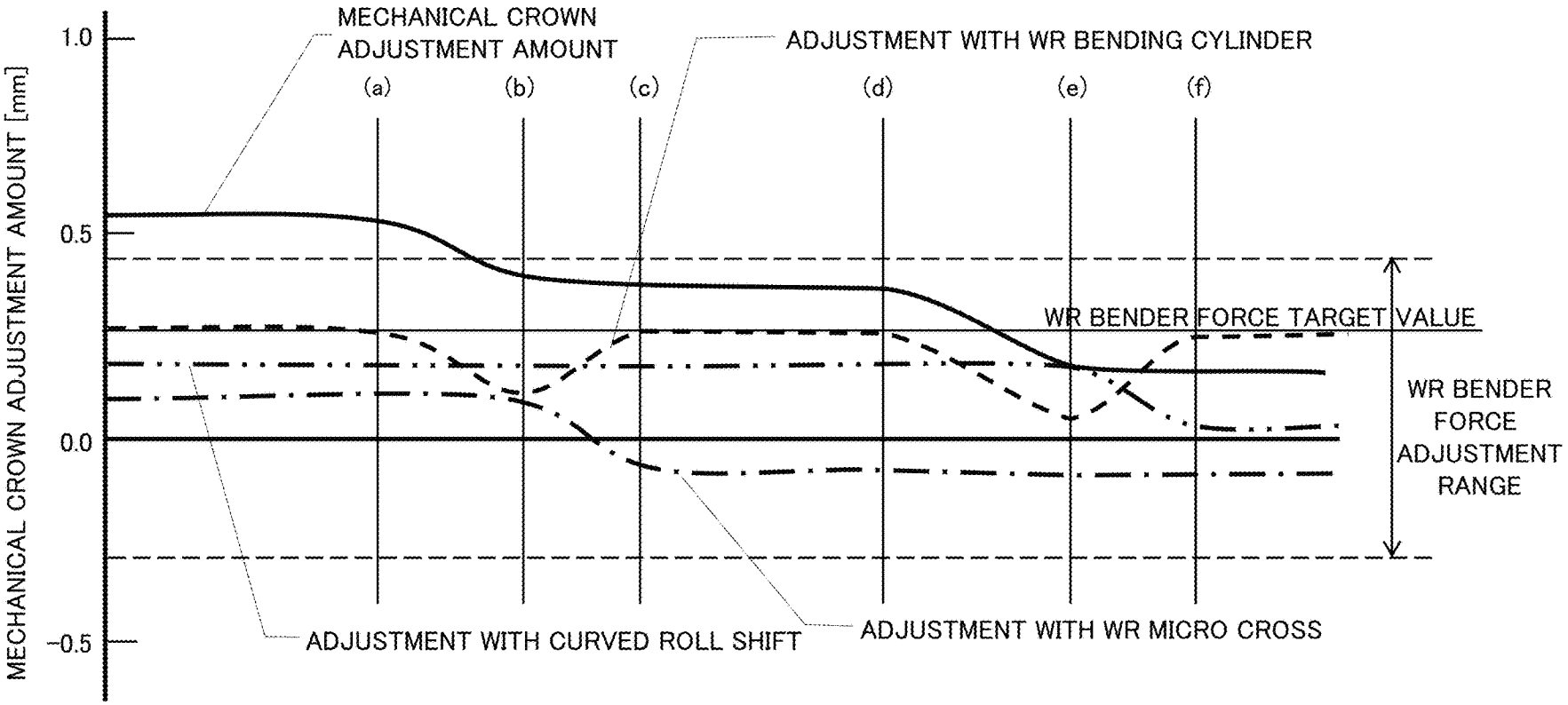
FIG. 11 is a figure depicting an overview of how to cope with a case where desired mechanical crown changes during rolling in the rolling mill according to the embodiment.

Next, a method of cross angle adjustment at the time of rolling by the rolling mill according to the present embodiment is explained with reference to FIG. 4 and subsequent figures. FIG. 4 is a figure for explaining the center of each roll in a crossed state. FIG. 5 is a figure for explaining each cross angle and each type of thrust force in the rolling mill. FIG. 6 to FIG. 8 are figures depicting the relationship between the cross angles and thrust coefficients. FIG. 9 is a figure depicting the relationship between the backup roll cross angle θb and $\theta wb_{base}$ at which the thrust force becomes 0. FIG. 10 is a figure depicting a state of the rolling mill according to the embodiment as seen from the rolling direction entry side. FIG. 11 is a figure depicting an overview in a case where desired mechanical crown changes during rolling.

In the crossed states depicted in FIG. 4 and FIG. 5, the first angle instruction section 20*a* of the control device 20 is a section that issues an instruction to adjust the angle between an upper side pair of the upper work roll 110A and the upper backup roll 120A and a lower side pair of the lower work roll 110B and the lower backup roll 120B in a state in which the upper side pair has a parallel state and besides in a state in which the lower side pair has a parallel state. The first angle instruction section 20*a* is preferably the main section to execute the first angle control step. Note that the nearer side of the paper surface is the work side, and the back side of the paper surface is the drive side in FIG. 4.

Preferably, the first angle instruction section 20*a* of the control device 20 according to the present embodiment performs commonly called pair cross of issuing an instruction to tilt the upper side pair of the upper work roll 110A and the upper backup roll 120A and the lower side pair of the lower work roll 110B and the lower backup roll 120B in mutually opposite directions on the horizontal plane in a state in which the upper side pair has a parallel state and besides in a state in which the lower side pair has a parallel state.

Note that whereas a case of a pair cross mill that changes the cross angle of the work rolls 110A and 110B along with the backup rolls 120A and 120B will be explained, the rolling mill and the rolling method of the present invention can be applied also to a work roll cross mill that changes the cross angle of only the work rolls 110A and 110B. In this case, the first angle instruction section 20*a* issues an instruction to adjust the angles between the upper side pair of the upper work roll 110A and the upper backup roll 120A and between the lower side pair of the lower work roll 110B and the lower backup roll 120B such that all the upper pair and the lower pair keep having parallel states (i.e. the angles are adjusted to be 0).

In addition, in the crossed states depicted in FIG. 4 and FIG. 5, the second angle instruction section 20*b* of the control device 20 is a section that issues an instruction to tilt the work rolls 110A and 110B in a state in which the angle between the backup rolls 120A and 120B is maintained. The second angle instruction section 20*b* is preferably the main section to execute the second angle control step.

It is desirable if an angle represented by an angle instruction value output by the second angle instruction section 20*b* is smaller than a maximum angle value represented by an angle instruction value output by the first angle instruction section 20*a*. That is, in the present embodiment, it is desirable if the cross angle between the upper work roll 110A and the lower work roll 110B after being caused to cross is increased further by a micro angle. For example, it is desirable if, in a pair cross state, the cross angle between the work rolls 110A and 110B is increased further preferably by a micro angle (e.g. equal to or smaller than 0.1°).

The axial position instruction section 20*c* of the control device 20 is a section that issues an instruction to move the work rolls 110A and 110B in a direction in which total thrust force received, by the work rolls 110A and 110B tilted by an instruction issued by the second angle instruction section 20*b*, from the backup rolls 120A and 120B and the rolled material S acts. This axial position instruction section 20*c* is preferably the main section to execute the axial position control step.

It is desirable if the second angle instruction section 20*b* and the axial position instruction section 20*c* mentioned above issue instructions at least during rolling of the rolled material S. That is, it is desirable if at least the second angle control step and the axial position control step are executed during rolling of the rolled material S.

The angle acquiring section 20*d* of the control device 20 is a section that acquires a thrust force 0 angle $\theta wb_{base}$ formed between the work rolls 110A and 110B and the backup rolls 120A and 120B at which the total thrust force received by the work rolls 110A and 110B becomes 0. The angle acquiring section 20*d* is preferably the main section to execute the angle acquisition step.

Such control has been found out on the basis of examinations and findings like the ones mentioned below.

For example, if a rolling facility including seven-stand rolling mill is considered, it is demanded that work rolls having straight contours are shifted during rolling in rolling mills of the sixth stand and the seventh stand, and work rolls having curved contours are shifted during rolling in rolling mills of the fourth stand and the fifth stand.

However, thrust force between a rolled material and work rolls, and thrust force between the work rolls and backup rolls are often generated randomly depending on the state of tilts between the rolls. Accordingly, there can be a case where the shift speed is extremely slow in one direction, but is extremely fast in the opposite direction, and also there can be the opposite case.

As for the sixth stand and the seventh stand, work roll shift aimed for wear dispersion is mainly demanded. However, although shift resistance force is small when the work rolls are shifted while the work rolls are rolling idle at breaks between rolled materials since rolling load is not acting thereon, rolling load acts on the work rolls continuously in endless rolling in which rolled materials are connected before a rolling facility, and rolling is continued without breaks, accordingly work roll shift for wear dispersion during endless rolling is constrained in the shift direction undesirably, and it becomes impossible to perform desired work roll shift.

In addition, rolling load is high in rolling at the fourth stand and fifth stand as compared to that at the sixth stand and the seventh stand. Accordingly, there is a constraint that work roll shift performed during rolling is significantly constrained.

As work rolls get more deformed thermally, it is necessary to gradually increase rolling load for maintaining a strip thickness if thermal deformation compensation for the work rolls and the temperature of a rolled material gradually lower undesirably. However, since increasing rolling load means bending the rolls such that the rolled material becomes convex, it becomes necessary to correct strip crown/strip shape control in the concave direction.

In preparation for a situation where adjustment of work roll bending cylinders is no longer sufficient for the adjustment, work roll micro cross during rolling or shift of work rolls having curved contours during rolling (shift during rolling) is desired to be executed.

In addition, there is rolling in which strip thickness change is performed during rolling, and this is called flying thickness change. Also when such flying thickness change is performed, a desired strip crown/strip shape is required to be obtained regardless of changes in rolling conditions. However, in a case where work roll bending cylinders do not provide adequate adjustment capability, work roll micro cross during rolling or shift of work rolls having curved contours during rolling is desired to be executed.

If it is possible to change the cross angle during rolling, coping with a greater range of condition changes during rolling is possible, but a mechanism necessary for cross angle change during rolling requires backup roll sliding devices having flat bearing sections which are expensive and large-sized. As compared to this, since a rolling mill having both functions for pair cross and work roll shift, first of all, includes shifting devices, even if the rolling mill does not have the backup roll sliding devices, if shifting the work rolls having curved contours during rolling is possible, it becomes possible to realize a considerable range of control with a relatively low-cost and simple structure.

Here, the total of both thrust force and frictional resistance force that act on work rolls when the work rolls are shifted during rolling becomes necessary as shift force. The frictional resistance force includes frictional resistance force of an offset component of rolling load, frictional resistance force of work roll bending cylinders, resistance force of drive spindle expanding/shrinking sections, and the like.

Since ((shift force)=(frictional resistance force)−(thrust force)) when thrust force is acting in the same direction as the shift direction, and (shift force=frictional resistance force+thrust force) when thrust force is acting in the direction opposite to the shift direction, adjustment of the direction of thrust force is important in terms of shift force reduction.

If there is an inclination between contacting rolls, a slide occurs in the axial direction between the rolls during rotation, and thrust force is generated. In addition, when one roll is moved in the axial direction, a slide in the axial direction occurs relative to the other roll, and thrust force acts on the rolls at that time. Since there is a tendency that thrust force that is generated when a roll is shifted in the axial direction increases as the shift speed increases, the necessary shift force=frictional resistance force+thrust force. When the necessary shift force is large, the shift speed becomes significantly slow in some cases, and the roll is not shifted at all in some other cases. In other words, by reducing thrust force or changing the direction of thrust force by changing the inclination between contacting rolls, it becomes possible to attain a shift speed which is an actually necessary speed.

FIG. 6 depicts results of calculation of thrust coefficients $\mu_{sw}$, $\mu_{wb}$, and $\mu_{total}$ at the time when the backup roll cross angle θb=0.5°. The thrust coefficients calculated are those at the time when the work rolls and the backup rolls are caused to cross together while the cross angle is within the range of 0° to 0.5°, and, after the backup roll cross angle θb has reached 0.5°, the work roll angle is increased in a state in which Ob is maintained. As can be seen in FIG. 6, the thrust force $Ft_{sw}$ that acts on the work rolls from a rolled material is $\mu_{sw}$×P, and μsw in a case where the thrust force $Ft_{sw}$ is force in the drive side direction as depicted in FIG. 5 is a negative value. In addition, the thrust force $Ft_{wb}$ that acts on the work rolls from the backup rolls is $\mu_{wb}$×P, and $\mu_{wb}$ in a case where the thrust force $Ft_{wb}$ is force in the work side direction as depicted in FIG. 5 is a positive value. The total thrust force $Ft_{total}$ that acts on the work rolls is $Ft_{sw}+Ft_{wb}=\mu_{total}\times P$, and $Ft_{total}$ becomes almost 0 when the work roll cross angle θsw is 0.5144°. The work roll micro cross angle θwb at this time is θsw−θb=0.0144°.

FIG. 7 depicts results of calculation of the thrust coefficients $\mu_{sw}$, $\mu_{wb}$, and $\mu_{total}$ at the time when the backup roll cross angle θb=1.0°. Similarly to FIG. 6, the thrust coefficients calculated are those at the time when the work rolls and the backup rolls are caused to cross together while the cross angle is within the range of 0° to 1.0°, and, after the backup roll cross angle θb has reached 1.0°, the work roll angle is increased in a state in which Ob is maintained. As can be seen in FIG. 7, $Ft_{total}$ becomes almost 0 when the work roll cross angle θsw is 1.0256°, and, at this time, the work roll micro cross angle θwb is θsw−θb=0.0256°.

FIG. 8 depicts calculation result at the time when the backup roll cross angle θb=1.5°. Similarly to FIG. 6 and FIG. 7, as can be seen in FIG. 8, $Ft_{total}$ becomes almost 0 when the work roll cross angle θsw is 1.5350°, and, at this time, the work roll micro cross angle θwb is θsw−θb=0.0350°.

As depicted in these FIG. 6 to FIG. 8, the absolute value of the thrust coefficient $\mu_{sw}$ between the rolled material and the work rolls increases as the work roll cross angle $\theta_{sw}$ increases, but, as compared to the tendency of increase in the absolute value, the degree of increase in the absolute value of the thrust coefficient $\mu_{wb}$ between the work rolls and the backup rolls when the work roll angle is increased in a state in which θb is maintained is rather significant, and a slight change in the work roll micro cross angle results in almost $\mu_{total}=\mu_{sw}+\mu_{wb}=0$.

FIG. 9 is a figure depicting the relationship between the backup roll cross angle θb and $\theta wb_{base}$ at which the thrust force becomes 0 in the rolling mill. FIG. 9 illustrates the work roll micro cross angle θwb=0.0144°, 0.0256°, and 0.0350° at which $Ft_{total}$ becomes almost 0 when θb=0.5°, 1.0°, and 1.5°, on the basis of FIGS. 6, 7, and 8. The vertical axis in FIG. 9 represents the work roll micro cross angle θwb at which the thrust force becomes 0, and this is defined as the thrust force 0 angle $\theta wb_{base}$. Then, when the work roll micro cross angle θwb is greater than the value of the thrust force 0 angle $\theta wb_{base}$ when θb is a certain angle, $Ft_{total}=Ft_{sw}+Ft_{wb}>0$, and the total thrust force acts in the work side direction. Accordingly, shift in the work side direction is easier in this case.

In addition, since making the work roll micro cross angle θwb greater than the thrust force 0 angle $\theta wb_{base}$ means increasing the work roll cross angle θsw, this produces an effect that the gap distribution (hereinafter, written also as "mechanical crown") between the upper work roll 110A and the lower work roll 110B is changed in the concave direction.

Here, the gap distribution (mechanical crown) is explained. The gap distribution (mechanical crown) in the present specification represents the difference between the inter-upper/lower work roll gaps at the roll middle and a roll end. Then, where mechanical crown in a certain state is treated as reference mechanical crown, a mechanical crown adjustment amount represents a mechanical crown change amount for attaining desired mechanical crown in the rolled state from the reference mechanical crown.

Specifically, using Hc denoting the inter-upper/lower work roll gap at the roll middle, and He denoting the inter-upper/lower work roll gap at the roll end, the mechanical crown Cce is expressed as He-Hc. In addition, using Cce1 denoting the reference mechanical crown, and Cce2 denoting the desired mechanical crown, the mechanical crown adjustment amount ΔCce can be expressed as Cce2−Cce1.

Here, for example, the roll end is a roll position equivalent to a strip width end of the largest strip width in the rolled material, a roll position equivalent to a position near the strip width end of the largest strip width, or the like, and is selected as appropriate as an evaluation position.

It can be known from this that, by making adjustment such that the mechanical crown changes in the concave direction when shift in the work rolls having curved contours+shift is performed toward the WS, the strip shape adjustment by work roll micro cross and the strip shape adjustment that can be made when the work rolls having curved contours are shifted in a direction in which the work rolls can be easily shifted due to work roll micro cross can be made the same.

In this manner, the angles of the work roll having curved contours are adjusted separately at two steps, and preferably the second adjustment is micro cross. Then, the work rolls are shifted in a direction in which the total thrust force that the work rolls receive from the backup rolls and the rolled material acts.

Next, a suitable detailed method of adjusting the cross angle at the time of rolling by the rolling mill according to the present embodiment is explained by using FIG. 10. Note that whereas the upper work roll 110A is caused to cross such that its drive side is positioned on the front side (the rolling direction exit side) in the case depicted in FIG. 10, the upper work roll 110A may also be caused to cross such that its work side is positioned on the front side. In that case, the orientations of the upper work roll 110A and the lower work roll 110B become opposite in the left/right direction.

Adjustment depicted in this FIG. 10 is made a timing at which desired mechanical crown between the upper work roll 110A and the lower work roll 110B is flat with a certain backup roll cross angle θb at a certain timing during rolling.

As depicted in (b) in FIG. 10, when the work roll micro cross angle θwb matches the thrust force 0 angle $\theta wb_{base}$, $Ft_{total}=Ft_{sw}+Ft_{wb}=0$, the total thrust force is 0, and, in this case, the thrust force that acts on the work rolls is 0. At this time, the mechanical crown is flat.

In addition, as depicted in (a) in FIG. 10, when the work roll micro cross angle θwb is greater than the thrust force 0 angle $\theta wb_{base}$, $Ft_{total}=Ft_{sw}+Ft_{wb}>0$, and the total thrust force acts in the work side direction. Shift in the work side direction is easier in this case. Shifting the work rolls in the work side direction produces an effect that the mechanical crown changes in the concave direction.

In view of this, in a case where the gap distribution between the upper work roll 110A and the lower work roll 110B in the axial direction is to be corrected in the concave shape direction, the second angle instruction section 20*b* issues an instruction to make the work roll micro cross angle θwb of the upper work roll 110A and the lower work roll 110B tilted by the second angle instruction section 20*b* greater than the thrust force 0 angle $\theta wb_{base}$ acquired by the angle acquiring section 20*d*.

In addition, the axial position instruction section 20*c* issues an instruction to move, closer to each other, a portion of the upper work roll 110A contacting the rolled material S at which portion the diameter of the upper work roll 110A is the largest (a portion with a diameter $D_{w1}$ in FIG. 2) and a portion of the lower work roll 110B contacting the rolled material S at which portion the diameter of the lower work roll 110B is the largest. In other words, the axial position instruction section 20*c* issues an instruction to move, away from each other, a portion of the upper work roll 110A at which the diameter of the upper work roll 110A is the smallest (a portion with a diameter $D_{w2}$ in FIG. 2) and a portion of the lower work roll 110B at which the diameter of the lower work roll 110B is the smallest.

Furthermore, as depicted in (c) in FIG. 10, when the work roll micro cross angle θwb is smaller than the thrust force 0 angle $\theta wb_{base}$, $Ft_{total}=Ft_{sw}+Ft_{wb}<0$, and the total thrust force acts in the drive side direction. Shift in the drive side direction is easier in this case.

In view of this, in a case where the gap distribution between the upper work roll 110A and the lower work roll 110B in the axial direction is to be corrected in the convex shape direction, the second angle instruction section 20*b* issues an instruction to make the work roll micro cross angle θwb of the upper work roll 110A and the lower work roll 110B tilted by the second angle instruction section 20*b* smaller than the thrust force 0 angle $\theta wb_{base}$ acquired by the angle acquiring section 20*d*.

In addition, the axial position instruction section 20*c* issues an instruction to move, away from each other, the portion of the upper work roll 110A contacting the rolled material S at which portion the diameter of the upper work roll 110A is the largest (the portion with the diameter $D_{w1}$) and the portion of the lower work roll 110B contacting the rolled material S at which portion the diameter of the lower work roll 110B is the largest. In other words, the axial position instruction section 20*c* issues an instruction to move, closer to each other, the portion of the upper work roll 110A at which portion the diameter of the upper work roll 110A is the smallest (the portion with the diameter $D_{w2}$) and the portion of the lower work roll 110B at which portion the diameter of the lower work roll 110B is the smallest.

By the adjustment, the strip shape adjustment by work roll micro cross and the strip shape adjustment that can be made when the work rolls 110A and 110B having curved contours are shifted in a direction in which the work rolls 110A and 110B can be easily shifted due to work roll micro cross can be made the same.

Adjustment explained next is made at a timing at which desired mechanical crown between the upper work roll 110A and the lower work roll 110B is flat when a certain backup roll cross angle θb is 0 at a certain timing during rolling.

When the work roll micro cross angle θwb matches the thrust force 0 angle $\theta wb_{base}$, $Ft_{total}=Ft_{sw}+Ft_{wb}=0$, the total thrust force is 0, and, in this case, the thrust force that acts on the rolls is 0. At this time, the mechanical crown is flat.

When the work roll micro cross angle θwb is greater than the thrust force 0 angle $\theta wb_{base}$ (=0), $Ft_{total}=Ft_{sw}+Ft_{wb}>0$, and the total thrust force acts in the work side direction. Shift in the work side direction is easier in this case. In view of this, adjustment is made to move, closer to each other, the portion of the upper work roll 110A contacting the rolled material S at which portion the diameter of the upper work roll 110A is the largest (the portion with the diameter $D_{w1}$) and the portion of the lower work roll 110B contacting the rolled material S at which portion the diameter of the lower work roll 110B is the largest. θwb becomes the same as the work roll cross angle θsw when θb is 0°, and the mechanical crown is changed in the concave direction when θwb is greater than $\theta wb_{base}$ (=0). Accordingly, both the strip shape adjustment by work roll micro cross and the strip shape adjustment that can be made when the work rolls 110A and 110B having curved contours are shifted in a direction in which the work rolls 110A and 110B can be easily shifted due to work roll micro cross can be made adjustment in the same concave direction.

When the work roll micro cross angle θwb is smaller than the thrust force 0 angle $\theta wb_{base}$, $Ft_{total}=Ft_{sw}+Ft_{wb}<0$, and the total thrust force acts in the drive side direction. Shift in the drive side direction is easier in this case. In view of this, adjustment is made to move, away from each other, the portion of the upper work roll 110A contacting the rolled material S at which portion the diameter of the upper work roll 110A is the largest (the portion with the diameter $D_{w1}$) and the portion of the lower work roll 110B contacting the rolled material S at which portion the diameter of the lower work roll 110B is the largest. θwb becomes the same as the work roll cross angle θsw when θb is 0°, the strip shape adjustment is made to change the mechanical crown in the concave direction also when θwb is smaller than $\theta wb_{base}$ (=0). On the other hand, the strip shape adjustment that can be made when the work rolls 110A and 110B having curved contours are shifted in a direction in which the work rolls 110A and 110B can be easily shifted due to work roll micro cross is made in the convex direction. These two types of shape adjustment are made in the opposite directions. On the other hand, since, first of all, θwb is a very small value (approximately 0.1° at the most) when θb is 0°, θsw, which has the same value as θwb, also is very small. Accordingly, a strip shape change in the concave direction generated by θsw is extremely small as compared to a strip shape change in the convex direction that can be attained by shifting the rolls in a direction in which the rolls can be easily shifted, and accordingly effects of the strip shape adjustment in the convex direction due to the shift can be attained effectively.

Next, advantages of the present embodiment are explained.

The control device 20 of the rolling mills 1 and 1A according to the present embodiment mentioned above includes: the first angle instruction section 20*a* that issues an instruction to adjust an angle between the upper side pair of the upper work roll 110A and the upper backup roll 120A and the lower side pair of the lower work roll 110B and the lower backup roll 120B in a state in which the upper side pair has a parallel state and besides in a state in which the lower side pair has a parallel state; the second angle instruction section 20*b* that issues an instruction to tilt the work rolls 110A and 110B in a state in which an angle between the backup rolls 120A and 120B is maintained; and the axial position instruction section 20*c* that issues an instruction to move the work rolls 110A and 110B in a direction in which total thrust force received, by the work rolls 110A and 110B tilted by the instruction issued by the second angle instruction section 20*b*, from the backup rolls 120A and 120B and the rolled material S acts. The control device 20 controls the work roll pressing devices 130A and 130B, the work roll fixed position controlling devices 140A and 140B, and the shift cylinders 115A and 115B on the basis of the instructions issued by the first angle instruction section 20*a*, the second angle instruction section 20*b*, and the axial position instruction section 20*c*.

As depicted in FIG. 11, a desired mechanical crown adjustment amount changes during rolling in some cases.

More specifically, at the timing of (a) in FIG. 11, a change in the mechanical crown adjustment amount is coped with by adjusting the upper work roll bending cylinder 190A and the lower work roll bending cylinder 190B when the mechanical crown adjustment amount changed.

Thereafter, at the timing of (b) in FIG. 11, work roll micro cross adjustment is started aiming for a target value of the work roll bender force, and adjustment is made such that the work roll bender force becomes the target value while the mechanical crown adjustment amount is maintained.

At the timing of (c) in FIG. 11, the work roll bender force reaches the target value due to work roll micro cross adjustment having been made at and after the timing of the (b), and the adjustment is almost completed, but, at this time, work roll micro cross adjustment has been almost fully used up. That is, this means that thrust bearings or roll necks of the work rolls 110A and 110B cannot endure if the absolute value of the work roll micro cross angle θwb is increased further, and this is a state where there is no way but to make adjustment by other means.

Thereafter, at the timing of (d) in FIG. 11, a change in the mechanical crown adjustment amount is coped with by adjusting the upper work roll bending cylinder 190A and the lower work roll bending cylinder 190B when the mechanical crown adjustment amount changed.

At the timing of (e) in FIG. 11, work roll micro cross adjustment can no longer be made further. Accordingly, aiming for a target value of the work roll bender force, shift adjustment of the work rolls 110A and 110B having curved contours is started, and adjustment is made such that the work roll bender force becomes the target value while the mechanical crown adjustment amount is maintained. At that time, since the work roll micro cross amount is in a direction in which movement of the shift of the work rolls 110A and 110B having curved contours is easy, it has become possible for the work rolls 110A and 110B to be shifted.

At the timing of (f) in FIG. 11, the work roll bender force reaches the target value due to the shift adjustment of the work rolls 110A and 110B having curved contours, and the adjustment is almost completed.

In this manner, the work rolls 110A and 110B are shifted after the thrust force generated in the work rolls 110A and 110B due to the shape control with the first angle adjustment is appropriately corrected by the second angle adjustment. Accordingly, the work rolls 110A and 110B can be shifted without applying large shift force, roll shift during rolling can be executed easily as compared to conventional technologies, and it becomes possible to appropriately control the shape of the rolled material S.

In addition, the control device 20 further has the angle acquiring section 20*d* that acquires the thrust force 0 angle $\theta wb_{base}$ formed between the work rolls 110A and 110B and the backup rolls 120A and 120B at which the total thrust force becomes 0. In a case where the gap distribution between the upper work roll 110A and the lower work roll 110B in the axial direction is to be corrected in the concave shape direction, the second angle instruction section 20*b* issues an instruction to make θwb greater than the thrust force 0 angle $\theta wb_{base}$ acquired by the angle acquiring section 20*d* while supposing that θwb is an angle formed between the work rolls 110A and 110B tilted by the second angle instruction section 20*b* and the backup rolls 120A and 120B, and the axial position instruction section 20*c* issues an instruction to move, closer to each other, portions of the upper work roll 110A and the lower work roll 110B contacting the rolled material S at which portions the upper work roll 110A and the lower work roll 110B have largest diameters. Accordingly, when the mechanical crown is being controlled such that it changes in the concave shape direction due to the angle adjustment by the first angle instruction, the work rolls are moved such that $\theta wb > \theta wb_{base}$, and are shifted such that the mechanical crown changes in the concave direction. Accordingly, it becomes possible to change the gap distribution to a more significantly concave shape, and the shape control range can be expanded.

Furthermore, in a case where the gap distribution between the upper work roll 110A and the lower work roll 110B in the axial direction is to be corrected in the convex shape direction, the second angle instruction section 20*b* issues an instruction to make θwb smaller than the thrust force 0 angle $\theta wb_{base}$ acquired by the angle acquiring section 20*d* while supposing that θwb is an angle formed between the work rolls 110A and 110B tilted by the second angle instruction section 20*b* and the backup rolls 120A and 120B, and the axial position instruction section 20*c* issues an instruction to move, away from each other, portions of the upper work roll 110A and the lower work roll 110B contacting the rolled material S at which portions the upper work roll 110A and the lower work roll 110B have largest diameters. Thereby, it becomes possible to make adjustment to change the mechanical crown in the convex shape direction. Accordingly, the tendency of changes in the width direction roll gap distribution generated by micro cross and the tendency of changes in the width direction roll gap distribution generated by shift can be made the same, thus a wider range of adjustment of the mechanical crown is enabled. For example, when strip crown adjustment simply with the upper work roll bending cylinder 190A and the lower work roll bending cylinder 190B in a bar during rolling becomes inadequate, both the micro cross function and the function of shifting the work rolls having curved contours can be used, and accordingly it becomes possible to use these for a wide range of strip crown adjustment.

In addition, the rolling mill further includes the backup roll pressing devices 150A and 150B and the backup roll fixed position controlling devices 160A and 160B that move the backup rolls 120A and 120B in the horizontal direction. The control device controls angle adjustment performed by the backup roll pressing devices 150A and 150B and the backup roll fixed position controlling devices 160A and 160B. The first angle instruction section 20*a* issues an instruction to tilt the upper side pair of the upper work roll 110A and the upper backup roll 120A and the lower side pair of the lower work roll 110B and the lower backup roll 120B in mutually opposite directions on the horizontal plane in a state in which the upper side pair has a parallel state and besides in a state in which the lower side pair has a parallel state. Thereby, it becomes possible to change θsw significantly, and the shape control range can be expanded further.

Furthermore, at least the second angle instruction section 20*b* and the axial position instruction section 20*c* issue instructions during rolling of the rolled material S. Accordingly, it becomes possible to run the rolling mill in a way that more easily follows changes in the required amount of the mechanical crown during rolling.

Others

Note that the present invention is not limited to the embodiment described above, but there can be various modifications and applications. The embodiment mentioned above is explained in detail in order to explain the present invention in an easy-to-understand manner, and the present invention is not necessarily limited to those including all the constituent elements explained.

For example, whereas the embodiment described above explained a case of a hot rolling mill and hot rolling method, the rolling mill and the rolling method of the present invention can also be applied to a cold rolling mill and cold rolling method.

DESCRIPTION OF REFERENCE CHARACTERS

1, 1A: Rolling mill
20: Control device
20*a*: First angle instruction section
20*b*: Second angle instruction section
20*c*: Axial position instruction section
20*d*: Angle acquiring section
30: Hydraulic device
100: Housing
110A: Upper work roll
110B: Lower work roll
112A: Work side roll chock
112B: Drive side roll chock
115A, 115B: Shift cylinder
120A: Upper backup roll
120B: Lower backup roll
130A, 130B: Work roll pressing device
140A, 140B: Work roll fixed position controlling device
150A, 150B: Backup roll pressing device
160A, 160B: Backup roll fixed position controlling device
170: Screw-down cylinder device
180: Load cell
190A: Upper work roll bending cylinder
190B: Lower work roll bending cylinder
200A, 200B: Backup roll sliding device
300A, 300B: Thrust force measuring device

The invention claimed is:

1. A rolling mill comprising:

a pair of upper and lower work rolls having curved contours with diameters that increase and decrease repetitively from one end to another end in an axial direction, the pair of upper and lower work rolls being arranged to be point symmetric with each other;

a pair of upper and lower backup rolls that support the work rolls, respectively;

work roll horizontal direction actuators that move the work rolls in a horizontal direction;

work roll axial direction actuators that move the work rolls in the axial direction; and a control device that controls angle adjustment performed by the work roll horizontal direction actuators, and axial position adjustment performed by the work roll axial direction actuators, wherein the control device has a first angle instruction section that issues an instruction to adjust an angle between an upper side pair of the upper work roll and the upper backup roll and a lower side pair of the lower work roll and the lower backup roll in a state in which the upper side pair has a parallel state and besides in a state in which the lower side pair has a parallel state, a second angle instruction section that issues an instruction to tilt the work rolls in a state in which an angle between the backup rolls is maintained, and an axial position instruction section that issues an instruction to move the work rolls in a direction in which total thrust force received, by the work rolls tilted by the instruction issued by the second angle instruction section, from the backup rolls and a rolled material acts, and controls the work roll horizontal direction actuators and the work roll axial direction actuators on a basis of the instructions issued by the first angle instruction section, the second angle instruction section, and the axial position instruction section.

2. The rolling mill according to claim 1, wherein the control device further has an angle acquiring section that acquires an angle $\theta wb_{base}$ at which the total thrust force becomes 0, the angle being formed between the work rolls and the backup rolls, in a case where a gap distribution between the upper work roll and the lower work roll in the axial direction is to be corrected in a concave shape direction, the second angle instruction section issues an instruction to make θwb greater than $\theta wb_{base}$ acquired by the angle acquiring section while supposing that θwb is an angle formed between the work rolls tilted by the second angle instruction section and the backup rolls, and the axial position instruction section issues an instruction to move, closer to each other, portions of the upper work roll and the lower work roll at which the upper work roll and the lower work roll have largest diameters, the portions contacting the rolled material.

3. The rolling mill according to claim 2, wherein in a case where the gap distribution between the upper work roll and the lower work roll in the axial direction is to be corrected in a convex shape direction, the second angle instruction section issues an instruction to make θwb smaller than $\theta wb_{base}$ acquired by the angle acquiring section while supposing that θwb is an angle formed between the work rolls tilted by the second angle instruction section and the backup rolls, and the axial position instruction section issues an instruction to move, away from each other, the portions of the upper work roll and the lower work roll at which the upper work roll and the lower work roll have the largest diameters, the portions contacting the rolled material.

4. The rolling mill according to claim 2, wherein at least the second angle instruction section and the axial position instruction section issue instructions during rolling of the rolled material.

5. The rolling mill according to claim 1, wherein the control device further has an angle acquiring section that acquires an angle $\theta wb_{base}$ at which the total thrust force becomes 0, the angle being formed between the work rolls and the backup rolls, in a case where a gap distribution between the upper work roll and the lower work roll in the axial direction is to be corrected in a convex shape direction, the second angle instruction section issues an instruction to make θwb smaller than $\theta wb_{base}$ acquired by the angle acquiring section while supposing that θwb is an angle formed between the work rolls tilted by the second angle instruction section and the backup rolls, and the axial position instruction section issues an instruction to move, away from each other, portions of the upper work roll and the lower work roll at which the upper work roll and the lower work roll have largest diameters, the portions contacting the rolled material.

6. The rolling mill according to claim 1, further comprising:

backup roll horizontal direction actuators that move the backup rolls in the horizontal direction, wherein the control device controls angle adjustment performed by the backup roll horizontal direction actuators, and the first angle instruction section issues an instruction to tilt the upper side pair of the upper work roll and the upper backup roll and the lower side pair of the lower work roll and the lower backup roll in mutually opposite directions on a horizontal plane in the state in which the upper side pair has the parallel state and besides in the state in which the lower side pair has the parallel state.

7. The rolling mill according to claim 1, wherein an angle represented by an angle instruction value output by the second angle instruction section is smaller than a maximum angle value represented by an angle instruction value output by the first angle instruction section.

8. A rolling method for a rolled material by a rolling mill including: a pair of upper and lower work rolls having curved contours with diameters that increase and decrease repetitively from one end to another end in an axial direction, the pair of upper and lower work rolls being arranged to be point symmetric with each other; a pair of upper and lower backup rolls that support the work rolls, respectively; work roll horizontal direction actuators that move the work rolls in a horizontal direction; and work roll axial direction actuators that move the work rolls in the axial direction, the rolling method comprising:

a first angle control step of adjusting an angle between an upper side pair of the upper work roll and the upper backup roll and a lower side pair of the lower work roll and the lower backup roll in a state in which the upper side pair has a parallel state and besides in a state in which the lower side pair has a parallel state;

a second angle control step of tilting the work rolls in a state in which an angle between the backup rolls is maintained; and an axial position control step of issuing an instruction to move the work rolls in a direction in which total thrust force received, by the work roll tilted at the second angle control step, from the backup rolls and the rolled material acts.

9. The rolling method according to claim 8, further comprising:

an angle acquisition step of acquiring an angle $\theta wb_{base}$ at which the total thrust force becomes 0, the angle being formed between the work rolls and the backup rolls, wherein in a case where a gap distribution between the upper work roll and the lower work roll in the axial direction is to be corrected in a concave shape direction, at the second angle control step, an instruction is issued to make θwb greater than $\theta wb_{base}$ acquired at the angle acquisition step while supposing that θwb is an angle formed between the work rolls tilted at the second angle control step and the backup rolls, and at the axial position control step, an instruction is issued to move, closer to each other, portions of the upper work roll and the lower work roll at which the upper work roll and the lower work roll have largest diameters, the portions contacting the rolled material.

10. The rolling method according to claim 9, wherein in a case where the gap distribution between the upper work roll and the lower work roll in the axial direction is to be corrected in a convex shape direction, at the second angle control step, an instruction is issued to make θwb smaller than $\theta wb_{base}$ acquired at the angle acquisition step while supposing that θwb is an angle formed between the work rolls tilted at the second angle control step and the backup rolls, and at the axial position control step, an instruction is issued to move, away from each other, the portions of the upper work roll and the lower work roll at which the upper work roll and the lower work roll have the largest diameters, the portions contacting the rolled material.

11. The rolling method according to claim 8, further comprising:

an angle acquisition step of acquiring an angle $\theta wb_{base}$ at which the total thrust force becomes 0, the angle being formed between the work rolls and the backup rolls, wherein in a case where a gap distribution between the upper work roll and the lower work roll in the axial direction is to be corrected in a convex shape direction, at the second angle control step, an instruction is issued to make θwb smaller than $\theta wb_{base}$ acquired at the angle acquisition step while supposing that θwb is an angle formed between the work rolls tilted at the second angle control step and the backup rolls, and at the axial position control step, an instruction is issued to move, away from each other, portions of the upper work roll and the lower work roll at which the upper work roll and the lower work roll have largest diameters, the portions contacting the rolled material.

12. The rolling method according to claim 8, wherein the rolling mill further includes backup roll horizontal direction actuators that move the backup rolls in the horizontal direction, and at the first angle control step, an instruction is issued to tilt the upper side pair of the upper work roll and the upper backup roll and the lower side pair of the lower work roll and the lower backup roll in mutually opposite directions on a horizontal plane in the state in which the upper side pair has the parallel state and besides in the state in which the lower side pair has the parallel state.

13. The rolling method according to claim 8, wherein at least the second angle control step and the axial position control step are executed during rolling of the rolled material.

14. The rolling method according to claim 8, wherein an angle represented by an angle instruction value output at the second angle control step is smaller than a maximum angle value represented by an angle instruction value output at the first angle control step.

* * * * *